US005080050A

United States Patent [19]

Dale

[11] Patent Number: 5,080,050

[45] Date of Patent: Jan. 14, 1992

[54] ROTARY ENGINE

[75] Inventor: Thomas W. Dale, Albertson, N.Y.

[73] Assignees: Irving M. Smith, part interest to each; James K. Smith, both of Babylon, N.Y. ; by said Thomas W. Dale, to each part interest

[21] Appl. No.: 471,382

[22] Filed: Jan. 29, 1990

[51] Int. Cl.[5] ..... F02B 57/02

[52] U.S. Cl. ..... 123/44 B; 123/44 E; 91/492

[58] Field of Search ..... 123/44 B, 44 E, 44 C; 91/492; 74/413, 421 A

[56] References Cited

U.S. PATENT DOCUMENTS

| | | | |
|---|---|---|---|
| 137,261 | 3/1873 | Taylor . | |
| 951,388 | 3/1910 | Conill . | |
| 2,303,685 | 12/1942 | Eden et al. | 91/492 |
| 3,270,685 | 9/1966 | Eickmann | 91/492 |
| 3,595,014 | 9/1971 | McMaster . | |
| 3,688,751 | 9/1972 | Sahagian . | |
| 3,841,279 | 10/1974 | Burns . | |
| 3,895,565 | 7/1975 | Schottler | 91/492 |
| 3,931,810 | 1/1976 | McGathey | 123/44 B |
| 3,960,029 | 6/1976 | Eichinger | 74/413 |
| 4,321,020 | 3/1982 | Mittal | 417/320 |

*Primary Examiner*—Richard A. Bertsch
*Assistant Examiner*—Charles Freay
*Attorney, Agent, or Firm*—Leonard Belkin

[57] ABSTRACT

A rotary internal combustion engine having spherical pistons mounted in radially arranged cylinders formed in a stacked series of rotatable cylindrical members. A stationary cam surface is located around the rotatable member to maintain contact with the pistons. A stationary member located with the rotatable cylindrical member provides fresh fuel mixture, withdraws exhaust products, and provides ignition as required. Power is taken from the rotating cylindrical members at the end of the engine through a planetary gear train.

8 Claims, 5 Drawing Sheets

ROTARY ENGINE

BACKGROUND OF THE INVENTION

This invention relates to a rotary internal combustion engine and more particularly to a rotary internal combustion engine utilizing spherical pistons.

The rotary engine, in which the shaft output is produced directly, rather than with the use of reciprocating connecting rods such as in the convention gasoline engine utilizing pistons reciprocating in cylinders, has been known for a long time.

U.S. Pat. No. 137,261 shows a rotary steam engine in which the output shaft is rotated by the reciprocal movement of cylindrical pistons and connecting rods.

U.S. Pat. No. 951,388 discloses a rotary combustion engine utilizing piston rods and rollers to cause the cylinders to rotate.

U.S. Pat. No. 3,595,014 teaches the use of spherical pistons which are actuated by hydraulic liquid pressurized by hydraulic vanes forming chambers which expand and contract in accordance with combustion in a combustion chamber.

U.S. Pat. No. 3,688,751 utilizes pistons with rollers along an outer cam surface, all of the pistons appearing to move in unison.

U.S. Pat. No. 3,841,279 discloses a rotary engine with cylindrical pistons having springs to bias the pistons outwardly, and utilizing rollers to ride on cam surfaces.

The arrangements described in the preceding patents are complex, expensive to manufacture, and difficult to maintain due to their relative complexity. None of these patents teaches the present invention.

The rotary engine has not been successfully utilized except in the most limited applications. Its complexity, manufacturing, and maintenance problems are some of the principal reasons for its lack of present use.

SUMMARY OF THE INVENTION

The present invention represents a substantial improvement in the rotary engine, avoiding many of the problems associated heretofore with this type of engine.

The rotary engine comprising this invention utilizes spherical pistons operating in a four cycle system of simple construction to a degree which has been unobtainable up to now.

In a preferred embodiment of the invention, the engine comprises a plurality of identical segments which are stacked, each segment staggered angularly so that the engine is completely balanced. Each segment, almost wafer-like in configuration, consists of spaced outer and inner stationary portions separated by a rotatable member containing sixteen cylinders, each with a spherical piston. A combustion chamber is formed radially inwardly of each piston and the inner stationary portion of each segment provides the air-fuel mixture, exhaust of the combustion products, and ignition. The outer stationary portion of each segment provides the cam surface on which each spherical piston rides. All of the rotating portions of the stacked segments are keyed together so that at one end of the engine is provided a gear system to deliver the shaft output of the engine. At the other end of the engine is arranged the fuel mixture input to all of the segments, fuel ignition, and exhaust manifold for the engine.

The configuration is elegant in its simplicity, has a relatively small number of moving parts, is relatively light in weight, and is easy to manufacture and maintain.

It is thus a principal object of this invention to provide a rotary combustion engine of simple and economic construction and ease of maintenance.

Other objects and advantages of this invention will hereinafter become obvious from the following description of a preferred embodiment of this invention.

DESCRIPTION OF THE PREFERRED EMBODIMENT

Figures 1, 2:
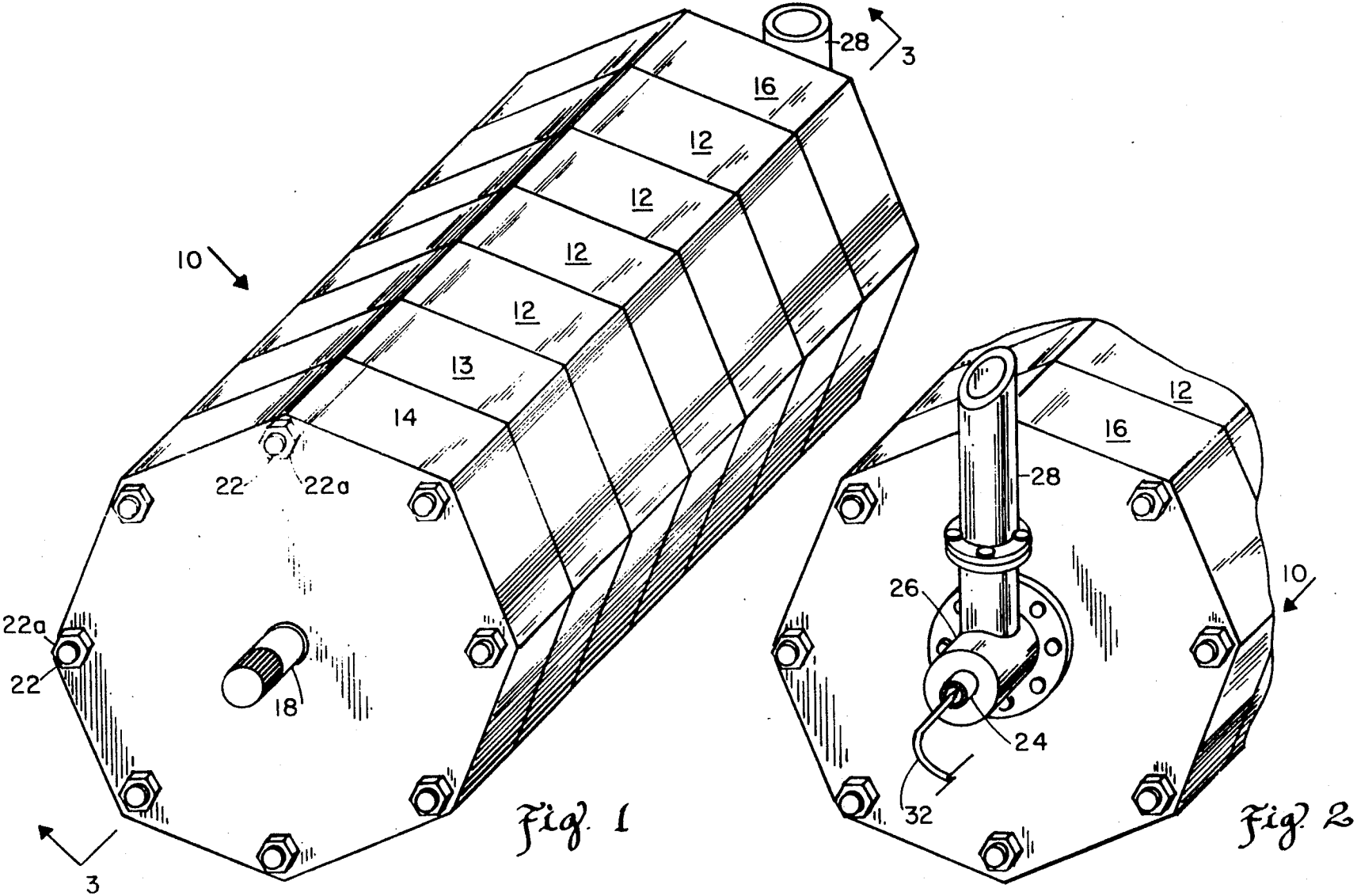
FIG. 1 is an isometric view of an engine embodying the principles of this engine from the end where the output power shaft extends.
FIG. 2 is a view similar to that of FIG. 1 from the opposite end of the engine.

Referring to FIGS. 1 and 2, there is illustrated rotary engine 10 consisting of stacked, identical power segments 12 sandwiched between power output segments 13 and 14 on the one hand, and accessory segment 16 on the other hand. Output of engine 10 is delivered by output shaft 18, and bolts 22 with nuts 22*a* hold the assembly together as shown. As shown in FIG. 2, fuel air mixture is delivered through an inner duct 24 while exhaust is provided by outer duct 26 to exhaust manifold 28. Fuel is injected from fuel line 32 into duct 24 as illustrated.

Figure 3:
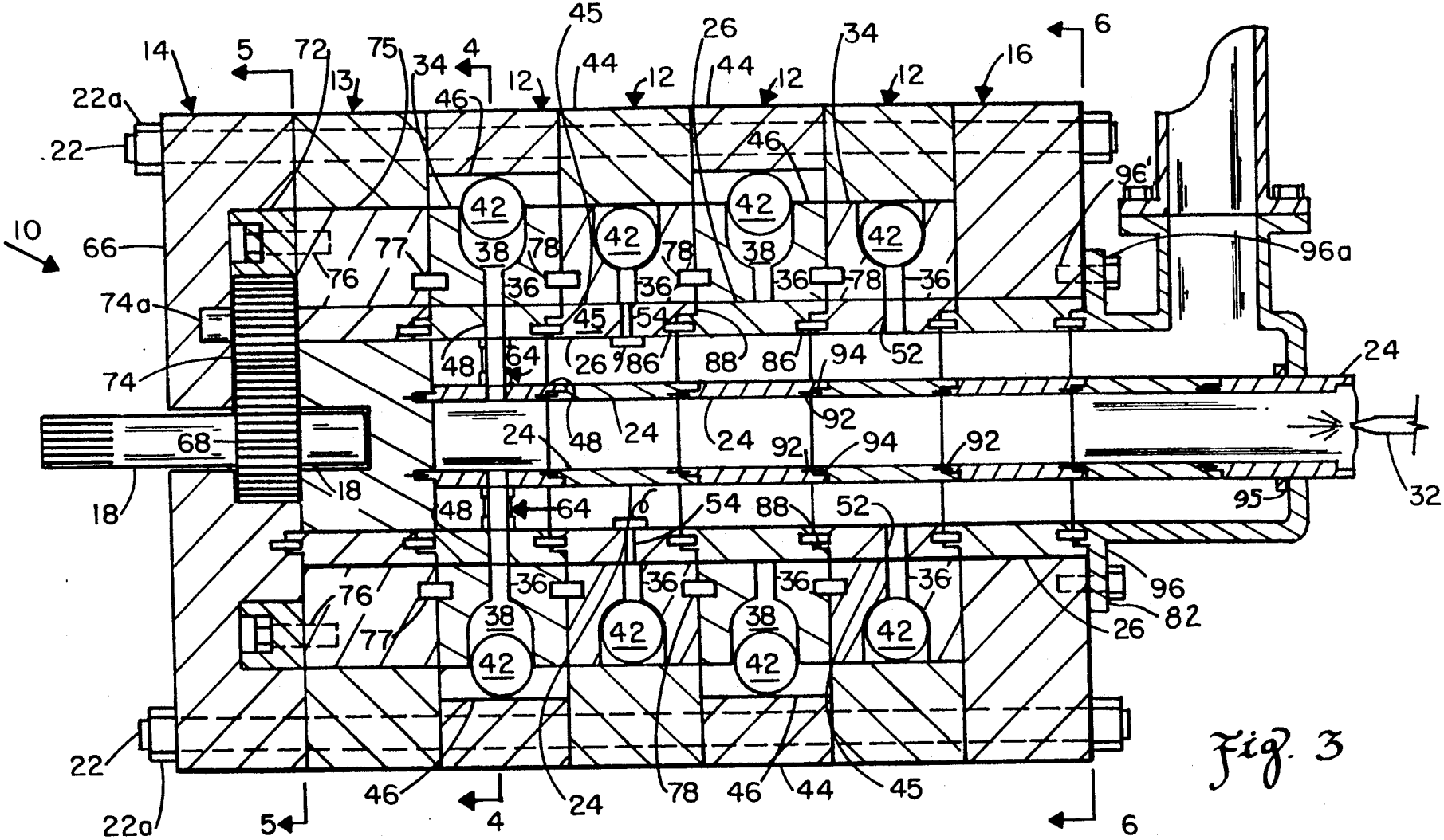
FIG. 3 is a section view taken along 3—3 of FIG. 1.
Figure 4:
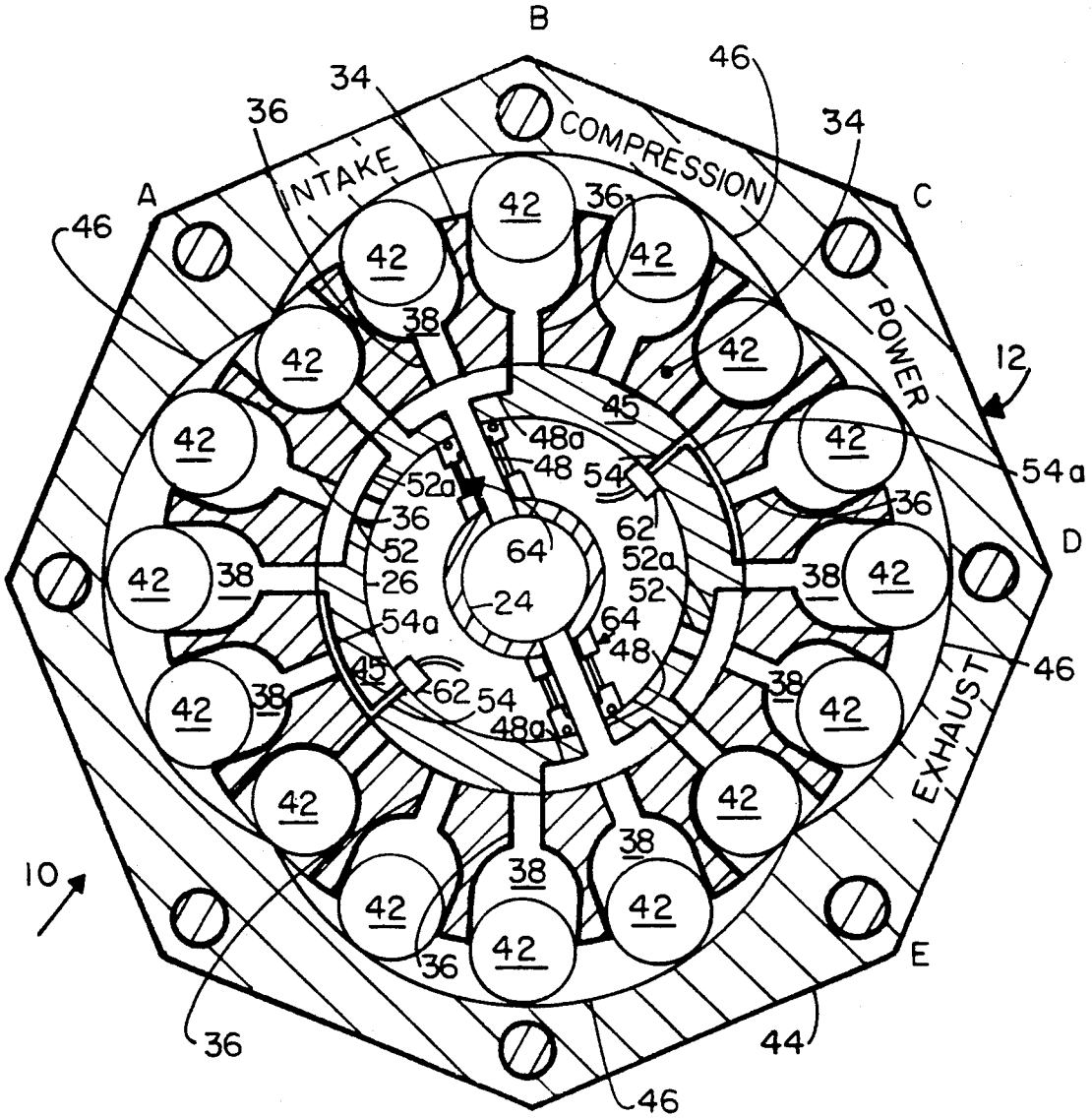
FIG. 4 is a section view taken along 4—4 of FIG. 3.
Figure 4A:
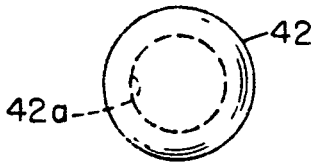
FIG. 4*a* is a view of a spherical piston.

As seen in FIGS. 3 and 4, each power segment 12 includes an annular, rotatable power member 34 containing a plurality of radially extending combustion chambers 36 and cylinders 38 in which spherical pistons 42 reciprocate in a manner to be described. As is understood in the art, combustion will take place in chamber 36 and cylinder 38 in communication with chamber 36. Each piston 42 may be hollow for a reason to be described below, as seen in FIG. 4*a* showing piston 42 with inner wall 42*a*.

Rotatable power member 34 is located between a stationary outer annular cam member 44 and a stationary inner member 45. Cam member 44 has concave, cam surfaces 46 on which spherical pistons 42 ride as shown.

Inner member 45 is made up of the air-fuel mixture conduit 24 and exhaust conduit 26. The wall of the latter is thickened to accomodate fuel-air mixture inlet ports 48 and exhaust ports 52, and ignition ports 54. Inlet ports 48 are relatively large so as to avoid any potential problem of clogging. It will be noted that ports 48, 52, and 54 are provided with expanded grooves 48*a*, 52*a*, and 54*a*, respectively. In the cases of ports 48 and 52 this is done so that intake and exhaust will take place while the respective pistons 42 cover the complete portion of cam surface 46 where such action occurs. In the case of ignition port 54, groove 54*a* makes it possible to utilize the combustion in one cylinder 36 to feed back to the next cylinder 36 in which there is a fresh mixture to be ignited so that ignition by spark or glow plug 62 connected to port 54 should only be required during starting of engine 10.

To carry fuel mixture from fuel-air mixture conduit 24 to port 48 there is provided a fuel supply assembly 64 which will be described further below.

It will be noted that in engine 10 there are provided four power segments 12 each one of which contains sixteen cylinders 38 with pistons 42. In each segment 12 one complete rotation results in each piston 42 undergoing two complete four cycle strokes, that is, two power strokes, two exhaust strokes, etc. If each adjacent segment 12 is offset radially 22.5 degrees then engine 10 is balanced.

Figure 5:
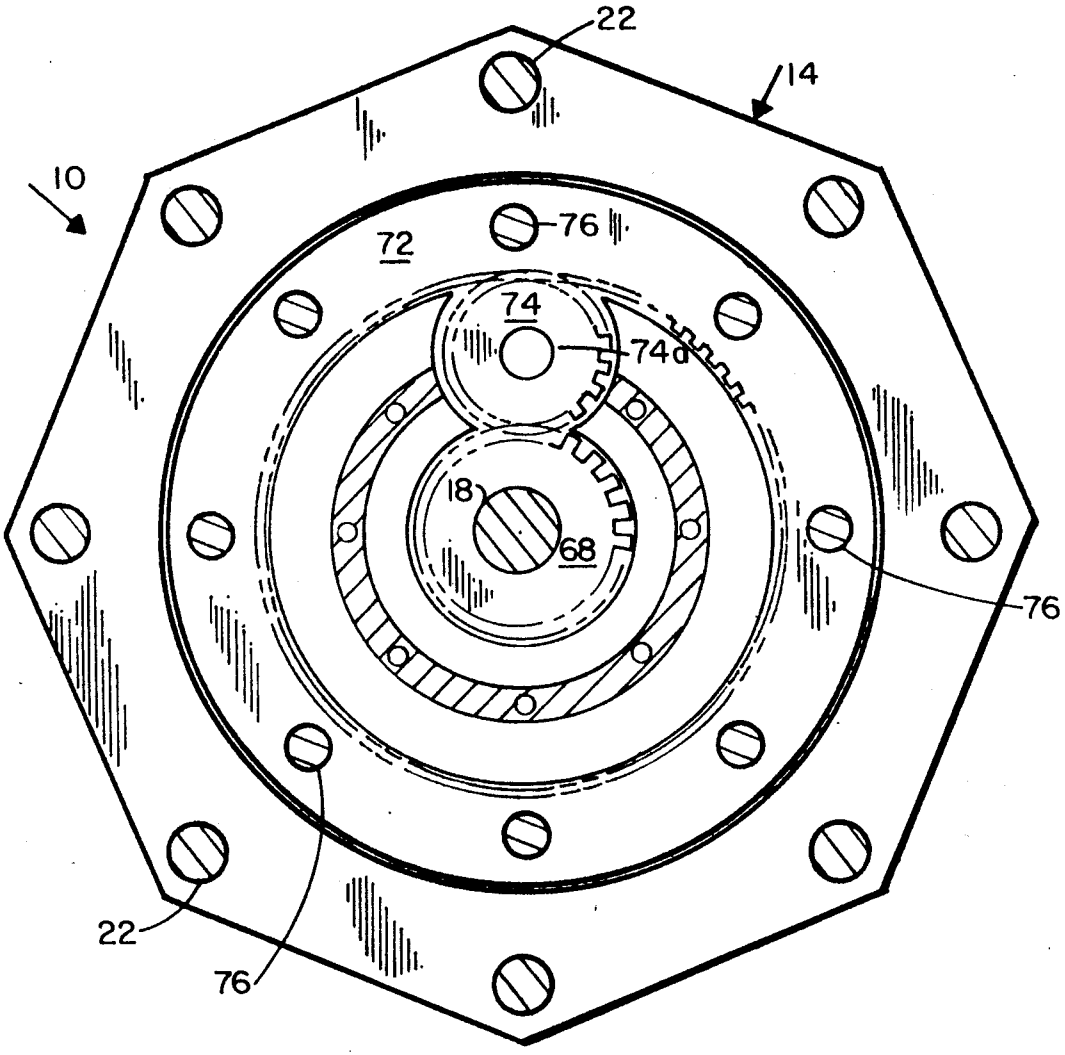
FIG. 5 is a section view taken along 5—5 of FIG. 3.

As also seen in FIG. 5, power output segment 14 consists of an end wall 66 which supports output power shaft 18 on which is mounted gear 68. A rotatable ring gear 72 is mounted within wall 66 and engages an idler gear 74 supported on a shaft 74*a*. Ring gear 72 is attached to the adjacent rotatable member 75 in segment 13 utilizing a plurality of bolts 76. Member 75 is pinned or keyed to rotatable member 34 in the adjacent power segment 12 by way of keys 77, and all rotatable members 34 in segments 12 are keyed together using keys 78 so that they all rotate together in unison, driving output power shaft 18 through the gear system just described. Segment 13 performs the primary function of supporting one end of shaft 18 opposite gear 68.

As best seen in FIG. 3, all of the stationary parts of segments 12, 13, 14, and 16 of engine 10, as well as the rotating members already described, are keyed together. Keys 86 are employed to join conduit 26 together, and it will be noted that stepped joints 88 are employed to insure that no lateral translation will take place. Keys or alignment pins 92 are employed for conduit 24, as well as stepped joints 94, and a retainer ring 95.

Figure 6:
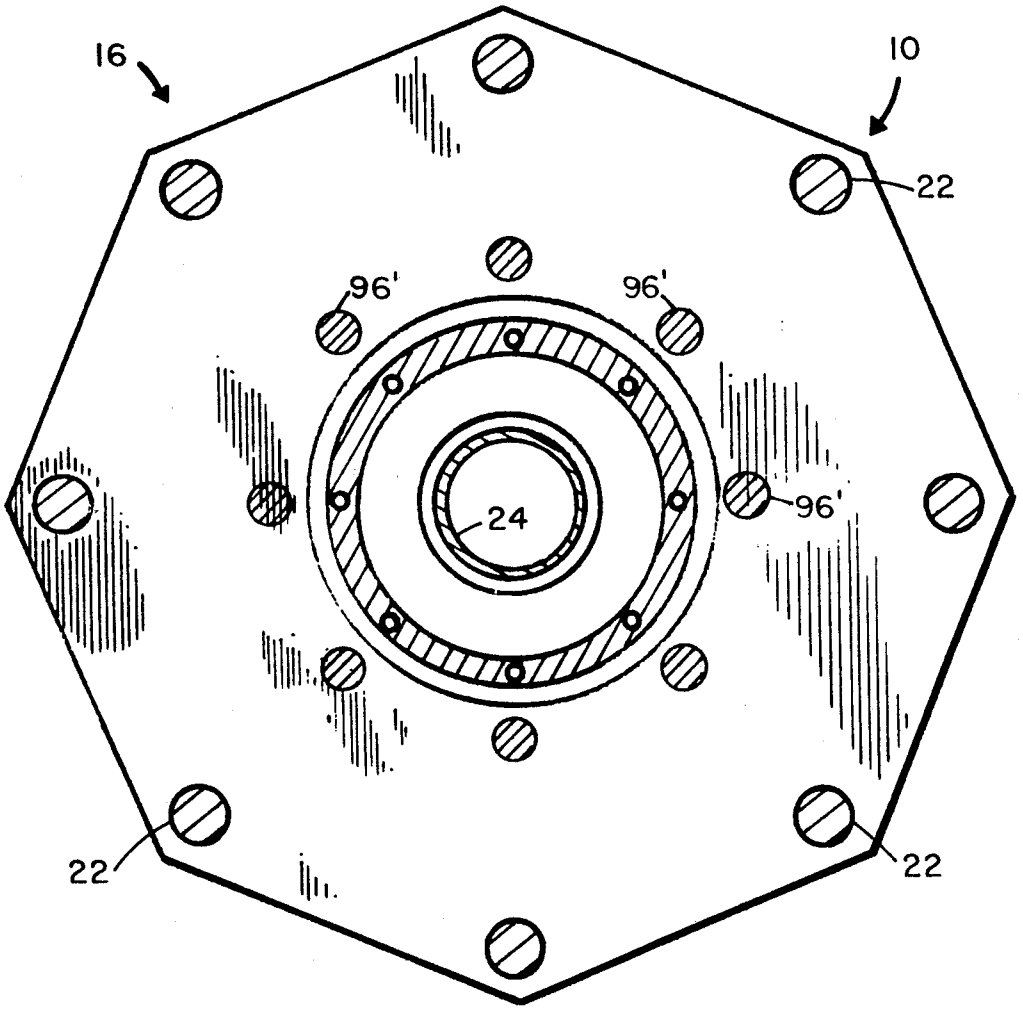
FIG. 6 is a section view taken along 6—6 of FIG. 3.

As also seen in FIG. 6, utility segment 16 is all stationary and provides a place for flange 96, nuts 96*a*, and bolts 96' to attach flange 82 and the various conduits previously described to engine 10. It should be noted that bolt 22 makes it possible to clamp the various segments of engine 10 together to a sufficient degree of compression for proper functioning of the engine to take place.

It is understood that while it is believed that little in the way of any lubricating or cooling system is required in the engine as described, such may be added as is found to be required.

Figure 8:
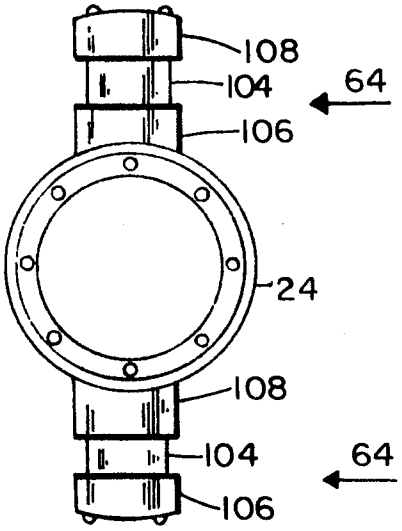
FIG. 8 is a right side view of the assembly shown in FIG. 7.
Figure 7:
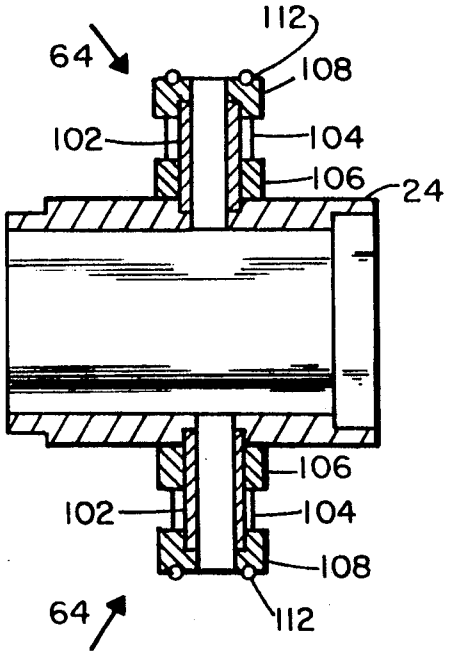
FIG. 7 is a detail of the fuel supply assembly shown in FIG. 3.

For details of fuel supply assembly 64, reference is made to FIGS. 7 and 8. For carrying the fresh fuel-air mixture from conduit 24 through the exhaust products between conduits 24 and 26 into port 48 there is provided a tube 102. To insure proper sealing and avoid leakage, a sleeve 104 is provided with a pair of collars 106 and 108 with an O-ring 112 mounted in upper collar 108. A band 114 surrounding sleeve 104 insures the integrity of the arrangement.

Operation of engine 10 may be described as follows: Start-up of the engine is initiated by driving output shaft 18. Centrifugal force insures that pistons 42 maintain contact with cam surface 46 during starting. Referring to FIG. 4, intake of fresh fuel-air mixture into combustion chamber 36 occurs in the region between A and B, with member 34 rotating clockwise. Compression of the mixture occurs in the region B to C. Ignition by spark or glow plug 62 occurs at point C. After engine 10 is running it will be noted that groove 54*a* provides a feedback from the adjacent combustion chamber 36 which is still fired so that it is anticipated it will no longer be necessary to fire plug 62. Power exapansion occurs in the region C to D where piston 42 is forced against cam surface 46 and causes rotation of member 34. Exhaust takes place during the region D to E, after which the cycle is repeated, twice during one complete rotation for each piston 42.

The use of spherical pistons in the cylinders where combustion takes place is believed to be a significant feature of this invention. In theory all contacts between a sphere and an adjacent surface is a point and in practice the area of contact is very small with the result that friction problems are minimized avoiding the need for any kind of rings and also the requirement for any elaborate cooling system. The use of hollow pistons permits a certain amount of mushrooming to take place with the result that seating between the piston and the cylinder wall is improved. The amount of mushrooming can be controlled by the thickness of the piston wall. Also, the construction is such that some of the new refractory materials being proposed for internal combustion engines can more readily be employed in an engine of the type herein described.

Rotating members 34 keyed together transfer the power output to shaft 18 through the gear arrangement described in connection with FIG. 5.

It is anticipated that in the engine just described a number of different fuels may be employed. In addition to gasoline, the engine may use diesel fuel or propane. One of the principal advantages of this rotary engine is in the lack of injectors to supply a measured amount of fuel during each intake. Injectors could become fouled over a period of time and this problem is avoided in this engine using intake ports 48 which are of sufficient diameter to avoid the problem. A conventional electronic device may be employed to monitor the need for fuel and meet the ongoing requirements of the engine. In addition, when diesel fuel is employed, the engine is largely self lubricating which reduces the need for any elaborate lubrication system.

It will also be noted that alignment and timing of the engine is fixed so that there is never a need, nor is there any provision, for making a timing adjustment. As in other rotary engines, the need for valves is eliminated with all of the attendant problems associated with valves.

The only engine bearings which are needed in this invention are located in end segments 13 and 14 so that they are conveniently located when it is necessary to service or replace them. Also, the bearings do not take the pounding from connecting rods found in the conventional reciprocating engine as well as other rotary engines with the result that there is much less likelihood that there will be bearing problems during the useful life of this engine.

An important feature of the invention is the simplicity in making repairs. The power segments are identical and are easily disassembled for easy replacement. In fact, the engine may be described as being modular in construction with the parts being assembled in the manner that many toys are snapped together.

Another important feature of this invention is that engine power and size can be tailored to any power need without any significant scaling or redesign of its parts. For example, to increase the power of the engine, additional power segments may be added.

From the foregoing description it is seen that a rotary engine has been provided which has features which represent a substantial advance in the art. While only a certain preferred embodiment of the invention has been described, it is understood that many variations are possible without departing from the principles of this invention as defined in the claims which follow.

What is claimed is:

1. A rotary engine comprising a rotatable cylindrical means containing a plurality of radially arranged cylinders open at both ends, a spherical piston in and freely movable within each of the aforesaid cylinders, stationary cam means surrounding said cylindrical means having a cam surface to contact the spherical piston within each of said cylinders and causing each said piston in its respective cylinder to reciprocate as said cylindrical means rotates, stationary core means within and enclosed by said rotatable cylindrical means for supplying and carrying away working fluid to and from said cylinders, a combustion chamber formed in said rotatable cylinder means for each said cylinder providing communication between each said cylinder and said stationary core means, said combustion chamber being smaller in cross section than said cylinder, means in said stationary core means forming a fresh fuel mixture port for communicating with said combustion chamber during the intake stroke of the piston for delivering to said combustion chamber a mixture of fuel and air, an exhaust port for carrying away exhaust products during the exhaust stroke of said piston, and an ignition port to supply ignition to said combustion chamber, said ignition port including means to feed back ignition to an adjacent combustion chamber in which there is a fresh mixture to be ignited, and shaft means connected to said rotatable cylindrical means to deliver output shaft power of said engine.

2. The rotary engine of claim 1 wherein said shaft means is connected to one end of said engine.

3. The rotary engine of claim 1 wherein said cylindrical means is comprised of a plurality of segments, each segment containing said plurality of said radially arranged cylinders and offset angularly from its adjacent segments, all of the rotatable cylindrical means in said segments being keyed to rotate together in unison.

4. The rotary engine of claim 3 wherein said stationary core means comprises a central working fluid supply duct, an exhaust duct for carrying away the exhausted working fluid, means transferring working fluid from said supply duct to said rotatable cylindrical means, and means for transferring exhausted working fluid from said rotatable cyclindrical means to said exhaust duct, the wall of said exhaust duct containing said parts communicating with said cylinders as said cylinders rotate to deliver fresh working fluid and withdraw exhausted working fluid in sequence.

5. The rotary engine of claim 4 wherein said engine has mounted at one end of said stacked segments a power output segment, said power output segment comprising a ring gear keyed to rotate with said rotatable cyclindrical means, an idler gear engaged to be rotated by said ring gear, and said shaft means comprising a power output shaft having a gear mounted thereon for being rotated by said idler gear.

6. A rotary internal combustion engine comprising a rotatable cylindrical means containing a plurality of radially arranged cylinders open at both ends, said cylindrical means being comprised of a plurality of segments, each segment containing said plurality of said radially arranged cylinders, all of the rotatable cylindrical means in said segments being keyed to rotate together in unison, a spherical piston in and freely movable within each of the aforesaid cylinders forming a chamber for combustion on the radially inward side of said piston, stationary cam means surrounding said cylindrical means having a cam surface to contact the spherical piston within each of said cylinders and causing each said piston in its respective cylinder to reciprocate as said cylindrical means rotates, stationary core means within said rotatable cylindrical means for supplying a fresh fuel-air mixture to and carrying away exhaust products from the combustion chambers, said stationary core means comprising a central fuel-air mixture supply duct, an exhaust duct for carrying away the exhaust products, and ignition means mounted on the inside of the wall of said exhaust duct, the wall of said exhaust duct including ignition port means to communicate said ignition means with said combustion chamber during the power stroke of said engine, the outside of the wall of said exhaust duct including groove means communicating with said ignition port means for igniting the combustion chamber in the adjacent segment having a compressed fuel-air mixture, fuel assembly means transferring said mixture from said supply duct to said combustion chamber, and means for transferring exhaust products from said combustion chambers to said exhaust duct, a power output segment mounted on one end of said engine, said power output segment comprising a ring gear keyed to rotate with said rotatable cylindrical means, an idler gear engaged to be rotated by said ring gear, and shaft means comprising a power output shaft having a gear mounted thereon for being rotated by said idler gear for delivering the shaft output of said engine.

7. The rotary engine of claim 6 in which said fuel assembly means comprises collar means engaged with the inside of said wall of said exhaust duct and collar means mounted on the outside of said supply duct, and conduit means interconnecting said collar means.

8. The rotary engine of claim 7 wherein each of said pistons is hollow.

* * * * *